US005707196A

United States Patent [19]

Brucker

[11] Patent Number: 5,707,196

[45] Date of Patent: Jan. 13, 1998

[54] CAP MAKING APPARATUS AND METHOD

[75] Inventor: Robert J. Brucker, Barnardsville, N.J.

[73] Assignee: Seal Spout Corporation, Liberty Corner, N.J.

[21] Appl. No.: 332,887

[22] Filed: Nov. 1, 1994

[51] Int. Cl.[6] ..... B21D 51/42; B21D 51/44; B31D 5/00

[52] U.S. Cl. ..... 413/8; 413/22; 413/53

[58] Field of Search ..... 413/8, 22, 53

[56] References Cited

U.S. PATENT DOCUMENTS

| | | | |
|---|---|---|---|
| 1,842,455 | 1/1932 | Lord | 413/22 |
| 2,892,430 | 6/1959 | Klausman | 113/1 |
| 3,381,645 | 5/1968 | Klausmann | 113/1 |
| 3,385,248 | 5/1968 | Klausmann et al. | 113/1 |
| 3,523,512 | 8/1970 | Plaessman | 113/1 |
| 3,690,223 | 9/1972 | Klausmann et al. | 93/53 |
| 3,734,361 | 5/1973 | Brucker et al. | 222/556 |
| 4,072,117 | 2/1978 | Plaessmann | 113/1 |
| 4,583,899 | 4/1986 | Plaessmann | 413/53 |
| 4,806,055 | 2/1989 | Plaessmann | 413/53 |
| 5,022,954 | 6/1991 | Plaessmann | 156/542 |
| 5,149,392 | 9/1992 | Plaessmann | 156/542 |

*Primary Examiner*—Jack W. Lavinder
*Attorney, Agent, or Firm*—Weingram & Associates, P.C.

[57] ABSTRACT

A method and apparatus is provided for forming a cap with a pouring spout for a container. A continuous web is fed to a spout inserting apparatus which inserts a spout directly into the continuous web. The continuous web may thereafter proceed to a label applicator which applies a label to the continuous web over the spout. Thereafter, the continuous web is moved past a dye and press wherein the cap is punched out of the continuous web and the edge is folded to form a cap. Thereafter, the caps are collected, oriented and directed to a point for subsequent use. Additionally, container bottoms may be made by the same method and apparatus. In such a case, the spout is not inserted into the web. Scrap is continuously removed after the caps are cut from the continuous web. The caps may be subsequently processed, i.e. attached to the tops and bottoms of containers.

2 Claims, 12 Drawing Sheets

FIG. 9
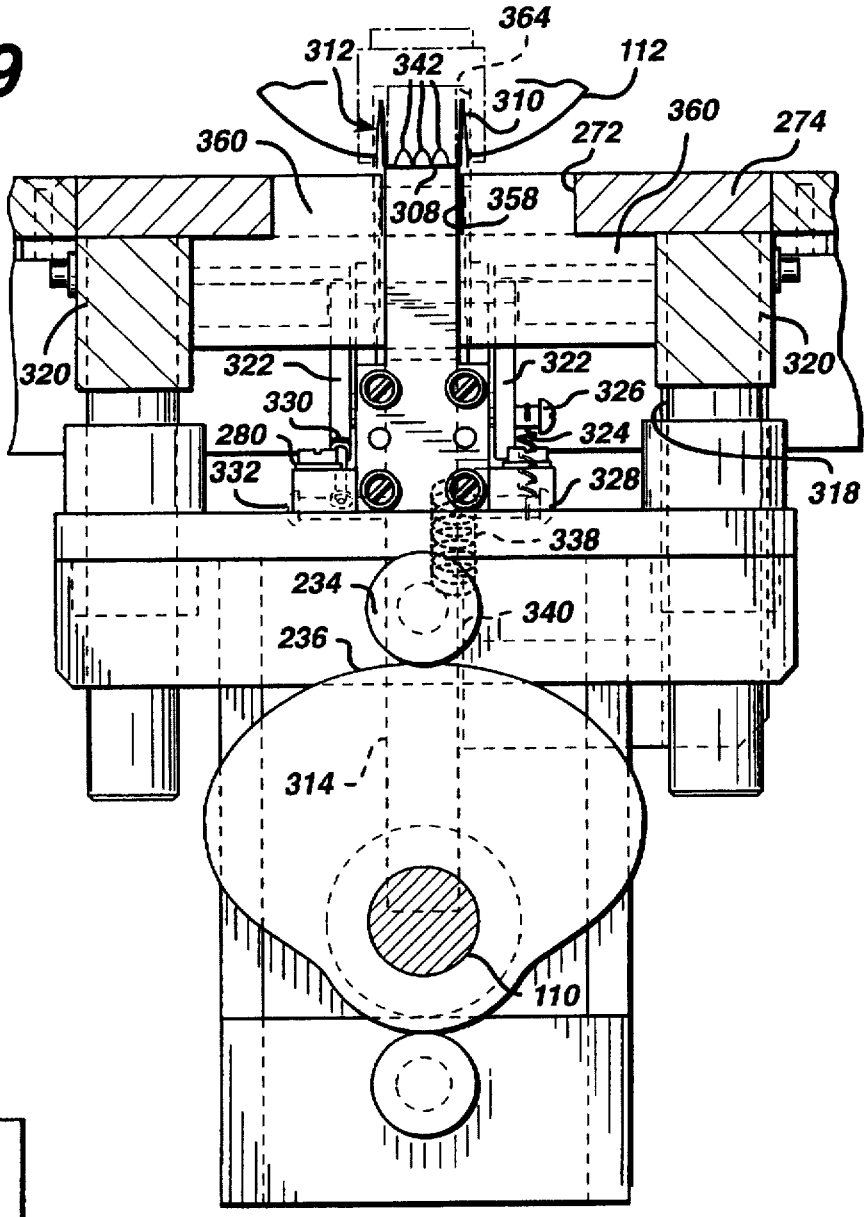
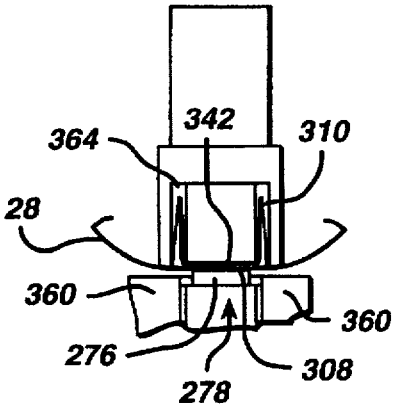
FIG. 11

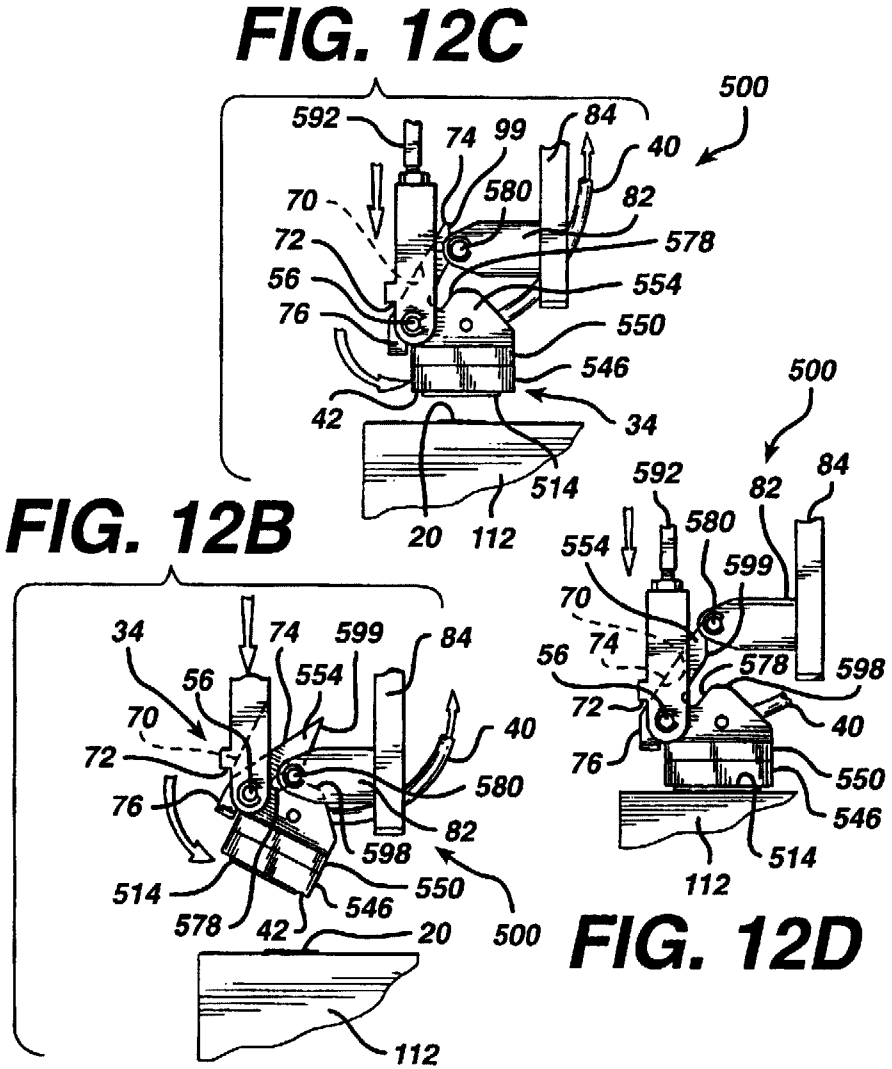
FIG. 12C
FIG. 12B
FIG. 12D
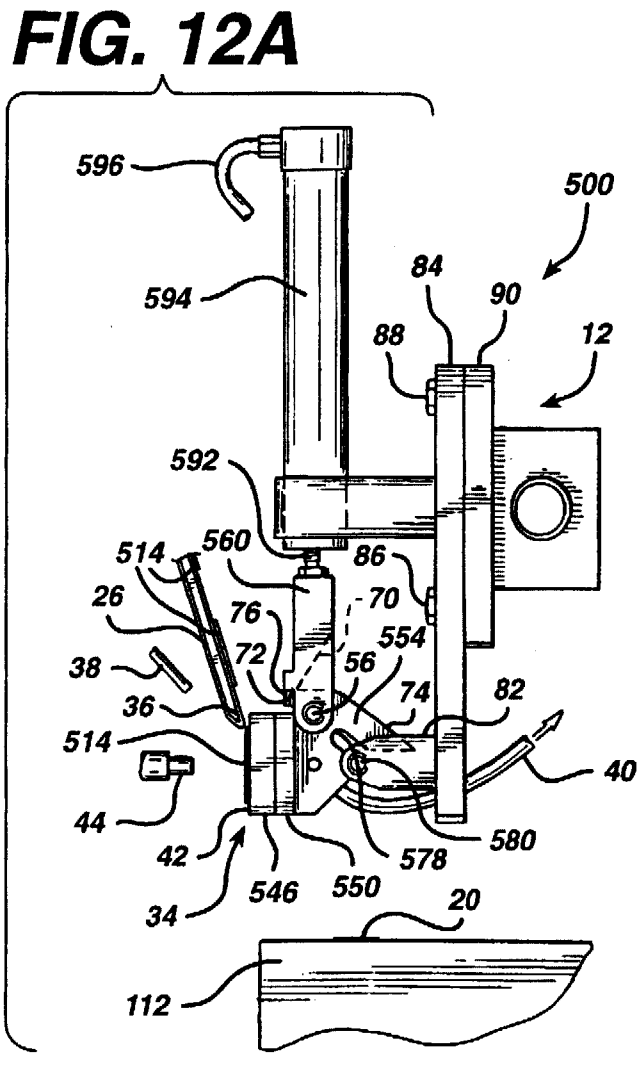
FIG. 12A

CAP MAKING APPARATUS AND METHOD

BACKGROUND OF THE INVENTION

1. Field of the Invention

The present invention relates to a method and apparatus for manufacturing a cap for a container with a pouring spout therein.

2. Description of the Prior Art

Machines for inserting spouts into containers have been known for a substantial period of time. Most of the better machines, however, place spouts on the side of the containers. It is a much more difficult task to place the spouts on the top of the container especially if the containers are round containers. Some of the problems associated with placing the spouts on the tops of round containers are that it is necessary to coordinate the position of the spout with the closed container. It is easier insert a spout on rectangular containers which are made as one-piece units in which the top is folded to form the top of the container. Because such a container is rectangular in shape the spout can always be oriented on one particular wall of the container.

There are many problems associated with placing spouts on the tops of round containers. One of the biggest problems involves the fact that the circular or disc shaped caps have to be made separately from the cylindrical portion of the container, and spouts then have to be inserted. Such a process of inserting spouts in circular caps is shown in U.S. Pat. No. 4,806,055 issued to Plaessman on Feb. 21, 1989 which is incorporated herein by reference.

Conventionally, the caps must first be formed, then spouts inserted, and then an orientation process has to be performed to insure that the spouts are in a specific location prior to any attempts at placing a seal or label or other tamper evident device over the spout. Additionally, the caps when formed are light and difficult to handle by the standard conveying process of pneumatic blowing or frictional transport.

Other examples of spout inserting machines are shown in U.S. Pat. Nos. 4,583,899; 4,072,117; 3,690,223; 3,523,512; 3,385,248; and 3,381,645. All of these patents are incorporated herein by reference.

Other problems that have been encountered in attempting to provide an apparatus to insert pouring spouts into the tops of containers have to do with the positioning of the container top during the insertion of the spout. The tops are relatively small and light, and it is difficult to immobilize the tops during the insertion process. Also, if one or more tops becomes misaligned in the insertion process, it can have a snowballing effect and disrupt the tops or caps that are following in the path of delivery for insertion of the pouring spout.

Further, it has been found difficult to position the cap or orient the cap in the appropriate relationship to the container so that the cap will always be placed onto the container with the spout in the desired position. Also, it is often difficult to maintain the pouring spouts in the desired position with relation to the cap, namely in the open or closed position. Uniformity in this area is of utmost importance.

Even with the spout machines described in the prior patents there are problems with respect to cutting out caps and then feeding the cut caps into a machine to insert a spout. These problems relate to material jams, i.e. the caps fed into the spout inserting machine tend to overlap adjacent caps to cause jams. Additionally, because individual caps must be manipulated by the spout inserting machines, there exist many opportunities for failures to occur. Accordingly, much time has been invested in the handling of caps.

Additionally, there is a need to install tamper indicating means on packages containing non-prescription drugs and consumable products having dry granular items such as bread crumbs, salt, or other fine powders that are dispensed from boxes or containers. One of the favorite methods of dispensing such granular material is by means of a retractable pouring spout that has been fastened to the box.

A problem associated with such spouts is that they are easily tampered with. There is no means by which it can be determined if the spout itself has been opened, other than by providing an overlay on the spout. It is important that such an overlay is positioned exactly on the spout, because if it is not, a contaminant may still be poured into the container through the spout. Thus, the positioning of the overlay label is critical. The label must be broken in order to open the spout. A broken sealing label will thus indicate that there has been tampering with the spout.

A known method for sealing spouts is by using a continuous wrapping, e.g. cellophane, to enclose the entire container. For containers which have a spout located on the flat top of the container, a label can be used. In the case of a container with a spout positioned on the side, however, difficulties arise in exactly positioning a sealing label over the spout due to seams, decorations, artwork, etc.

The exact positioning of a label in relation to the spout can be important in maintaining a seal to insure the usefulness of the product therein. For example, in containers which have water sensitive material such as soaps or detergents a label which overlays the spout so as to hermetically seal the spout opening is advantageous in extending the shelf life of the material in the container. The prevention of moisture from entering the container will enable the material to stay in the box without caking or otherwise absorbing the material.

Further, as is often the case in the retail trade, containers having pouring spouts are often stacked one on top of the other. Such stacking tends to crush or distort the containers. By placing a label over the spout it prevents the spout from being forced open by such crushing thereby preventing spilling of the materials from the containers while also making the material in the individual containers less vulnerable to contamination.

OBJECTS AND SUMMARY OF THE INVENTION

A primary object of the present invention is to provide a method to form a cap with an inserted spout from a continuous web.

Another object of the present invention is to provide a method to form caps from a continuous web which may have spouts and taper evident labels attached.

Still another object of the present invention is to provide a method to insert spouts directly on a continuous web.

A further object of the present invention is to provide a method to form a cap before inserting a spout.

An even further object of the present invention is to provide a method to form both caps and bottoms in the same process.

Yet a further object of the present invention is to provide a method to cover and seal the spout closed before forming the cap.

It is still a further object of the present invention to provide a method to form a cap that does not affect the disposition of the spout when forming the cap.

It is yet another object of the present invention to provide a method to increases the accuracy of the positioning of the spout in the cap.

Another object of the present invention is to provide a method to enable the cap to be formed with either an open or closed spout already inserted.

Even another object of the present invention is to provide a method to form caps on a continuous web in a manner to minimize wastage.

Still even another object of the present invention is to provide a method to form caps on a continuous web in a manner to maximize the production from the inputted material.

Yet even another object of the present invention is to provide a method to separate the formed cap with the inserted spout from the web.

It is a further object of the present invention to provide a method to separate the scrap material in a manner to reduce clutter and avoid hazardous working conditions.

Even a further object of the present invention is to provide a method to insert a spout in cap that does not require independent support for the web during the operating processes.

Still a further object of the present invention is to provide a method to use existing equipment in combination and sequence to produce an unusual result.

Yet a further object of the present invention is to provide a method which orients the caps with spouts after the formation of the cap.

Another object of the present invention is to provide a method to form a cap which is efficient.

Even another object of the present invention is to provide a method to form a cap which is easy to regulate.

Still even another object of the present invention is to provide an apparatus to form a cap with an inserted spout from a continuous web.

Another object of the present invention is to provide an apparatus to form caps from a continuous web which may have spouts and taper evident labels attached.

Still another object of the present invention is to provide an apparatus to insert spouts directly on a continuous web.

A further object of the present invention is to provide an apparatus to form a cap before inserting a spout.

Still a further object of the present invention is to provide an apparatus to form both caps and bottoms in the same process.

Yet a further object of the present invention is to provide an apparatus to cover and seal the spout closed before forming the cap.

It is still a further object of the present invention to provide an apparatus to form a cap that does not affect the disposition of the spout when forming the cap.

It is yet another object of the present invention to provide an apparatus to increases the accuracy of the positioning of the spout in the cap.

Another object of the present invention is to provide an apparatus to enable the cap to be formed with either an open or closed spout already inserted.

Even another object of the present invention is to provide an apparatus to form caps on a continuous web in a manner to minimize wastage.

Still even another object of the present invention is to provide an apparatus to form caps on a continuous web in a manner to maximize the production from the inputted material.

Yet even another object of the present invention is to provide an apparatus to separate the formed cap with the inserted spout from the web.

It is a further object of the present invention to provide an apparatus to separate the scrap material in a manner to reduce clutter and avoid hazardous working conditions.

Even a further object of the present invention is to provide an apparatus to insert a spout in cap that does not require independent support for the web during the operating processes.

Still a further object of the present invention is to provide an apparatus to use existing equipment in combination and sequence to produce an unusual result.

Yet a further object of the present invention is to provide an apparatus which orients the caps with spouts after the formation of the cap.

Another object of the present invention is to provide an apparatus to form a cap which is efficient.

Even another object of the present invention is to provide an apparatus to form a cap which is easy to regulate.

To overcome the problems of handling formed caps, inserting spouts in the caps in specifically designated locations and then aligning the inserted caps in order to obtain accurate positioning for covering of the caps by tamper evident means, the present invention sets forth apparatus and method by which a continuous flat web from which caps will be subsequently formed is first processed to insert spouts at predetermined locations. Next, the spouts may be covered them with tamper evident materials. Finally, the caps are punched from the web, and then formed into caps. Thereafter, the caps are collected, oriented and directed to a point for subsequent use. Additionally, container bottoms may be made by the same method and apparatus. In such a case, the spout is not inserted into the web. Scrap is continuously removed after the caps are cut from the continuous web. The caps may be subsequently processed, i.e. attached to the tops and bottoms of containers.

The invention comprises apparatus for transporting a continuous web of stock material from which caps will be formed. The first stage includes apparatus for inserting spouts into the web at predetermined positions. A second stage provides apparatus for covering the inserted spout. A third stage then provides apparatus for forming the caps from the continuous web. The cap forming process can be in registration with predetermined patterns applied to the web for decorative purposes. The formed caps with spouts and with tamper evident covering means or sealing means are then aligned in a fourth stage by apparatus to align the caps and spouts for attachment onto the tops of cylindrical containers. Flexibility arises in the invention in that tops and bottoms can simultaneously be formed from the same web.

BRIEF DESCRIPTION OF THE DRAWINGS

Other important objects and features of the invention will be apparent from the following Detailed Description of the Invention taken in connection with the accompanying drawings in which:

FIG. 9 is a horizontal sectional view taken along line 9—9 of FIG. 7.

FIG. 11 is a fragmentary sectional view through the web and showing the ram and anvil of the machine in end elevation.

FIG. 12A is a side view of a label feeding mechanism, having the label on the receiving pad, just after being deposited thereon.

FIG. 12B is a partial side view of the label receiving station, having a label on the receiving pad, as the receiving station is being moved toward the web.

FIG. 12C is a partial side view of the label receiving station, having the label on the receiving pad, as the receiving station is being moved toward the web, just prior to contact of the label with the web.

FIG. 12D is a partial side view of the label receiving station showing the label in contact with and being adhesively applied to the web.

DETAILED DESCRIPTION OF THE INVENTION

Figure 1:
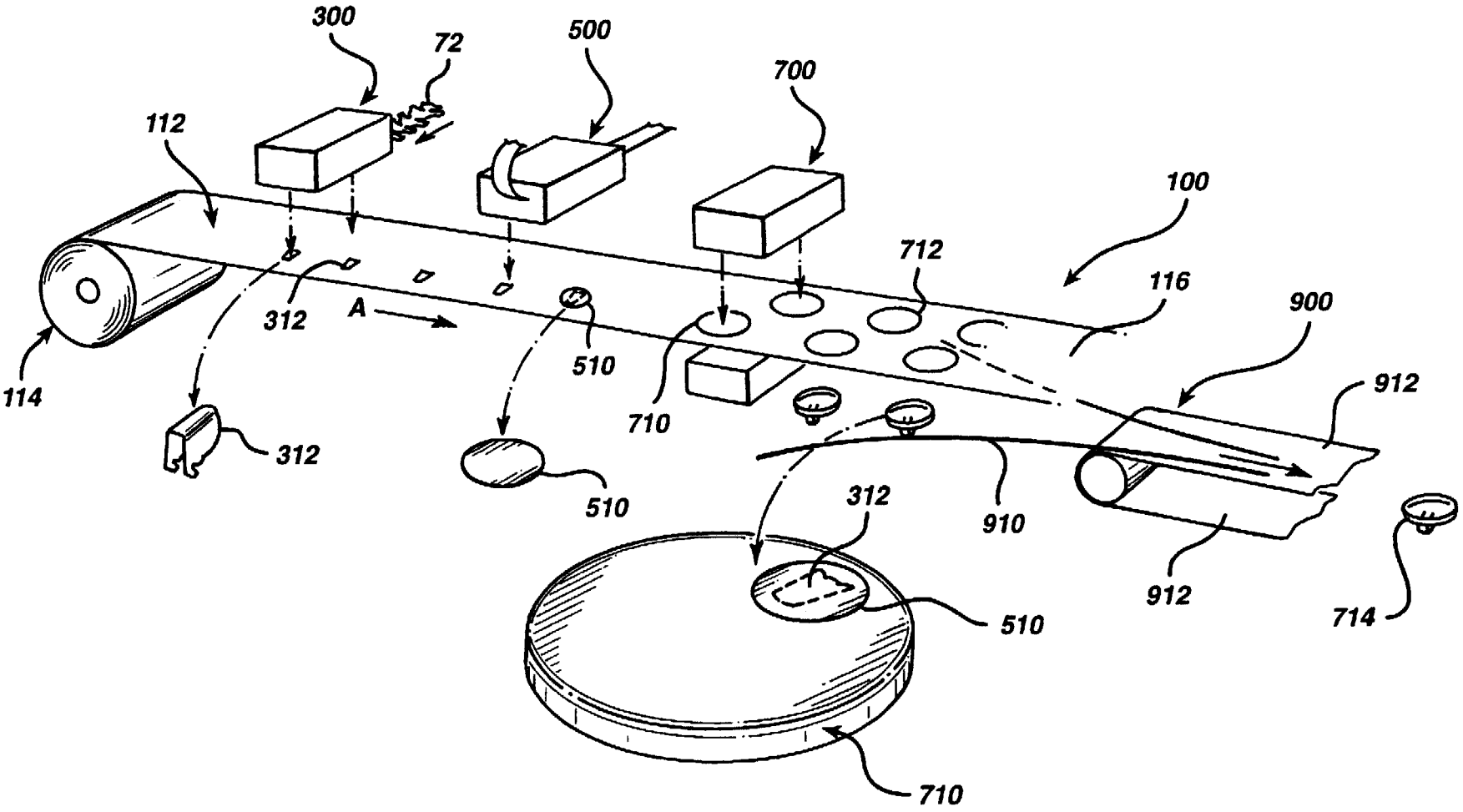
FIG. 1 is an inverted schematic view of the process of inserting spouts and forming container caps.

As showing in FIGS. 1–5 a continuous web 112 of stock material mounted on a supply role 114 feeds an endless sheet of stock material along a transport path, generally indicated as 100, in a direction of travel A. Above or below the path of travel are work stations generally indicated as 300, 500, 700 and 900, where various stages or work is performed.

The first stage includes a spout inserting apparatus generally indicated at 300 for inserting a spout 312 into the web 112.

The web 112 then proceeds to the second stage which includes a label applying apparatus generally indicated at 500 for applying tamper evident labels 510 over spouts 312.

Subsequently the web 112 moves to a third stage which includes a die and press or punching apparatus generally indicated at 700 which punches the caps 710 from the web 112.

The caps 710 are thereafter moved to a transporting section 900 for transporting the caps 710 to a position for further processing, i.e. attachment to a container. The scrap 116 portion of the web remaining after the formation of the cap removed is by a scrap removal apparatus not shown.

Figure 2:
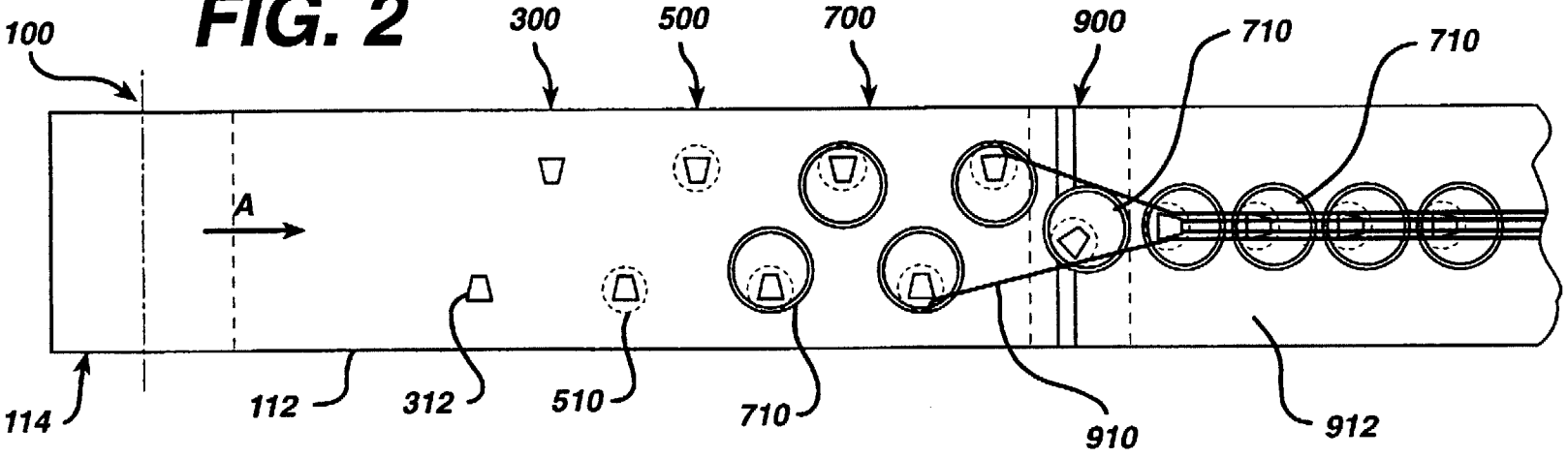
FIG. 2 is another schematic representation of the process of inserting spouts and forming caps from a continuous web.
Figure 4:
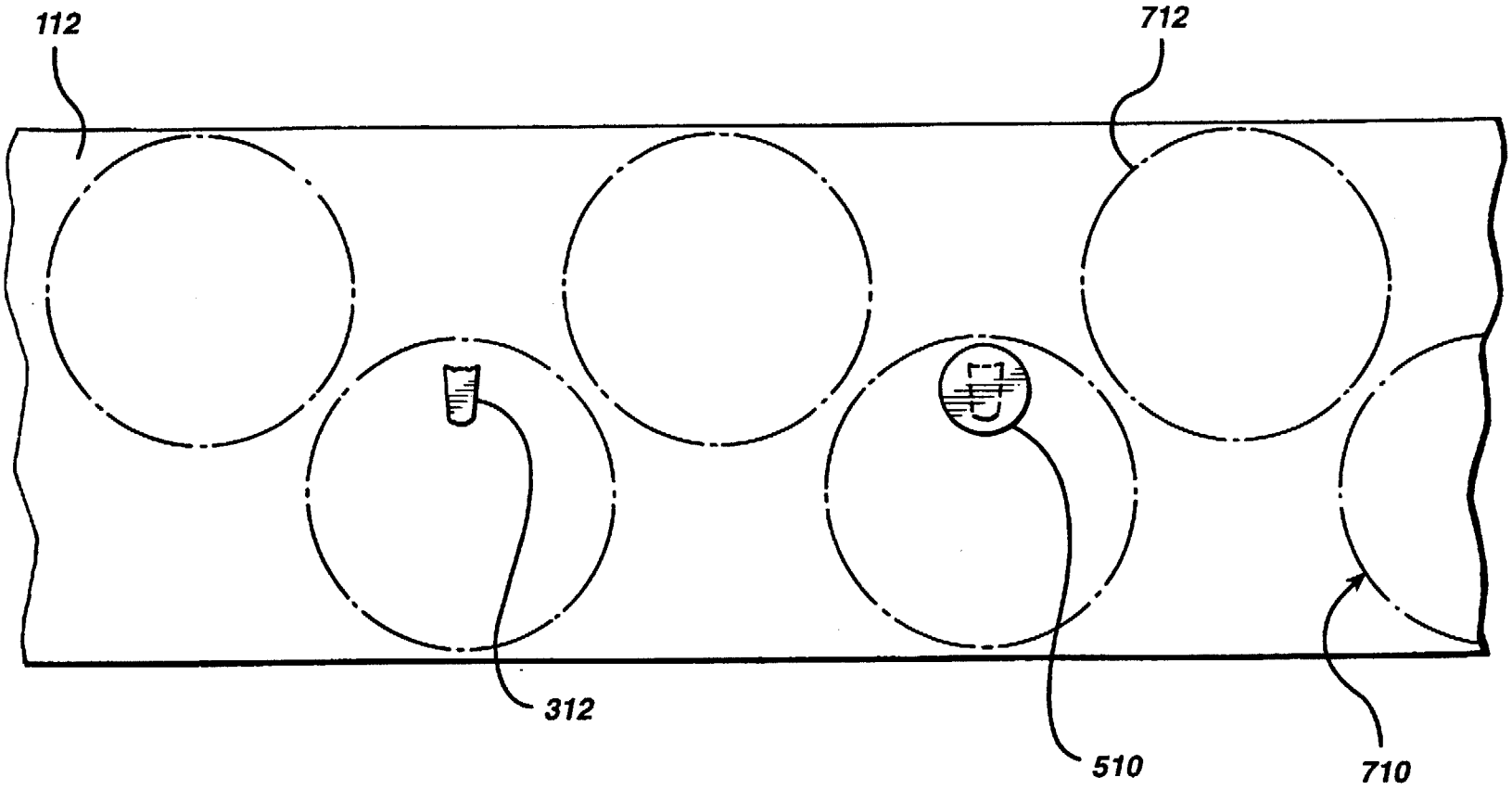
FIG. 4 is an enlarged top view of a portion of FIG. 1 showing a web with some spouts inserted and some labels applied.

The web material 112 is comprised of any standard material that can be used to form caps such as cardboard, press board or plastic substitutes therefore and/or any other desired material. As shown in FIGS. 2 and 4 the spout inserting apparatus 300 will insert a spout 312 at specific uniform locations in registration with a pattern of caps produced on the web 112. The spout insertion location can be adjusted as desired to accommodate a desired cap layout pattern on the web 112. These patterns will be designed and produced in advance or before the web 112 is placed on the web dispensing apparatus 100. Any other designs or other indicia that are desired for the top of the cap can also be accommodated.

As shown in FIG. 4, it is not necessary that caps 710 placed on both sides of the web 112 or that two rows of caps 710 be made from the web 112. It is equally possible to have caps 710 formed with spouts 312 on one side of the web 112 and then the other side of the web 112 be used for formation of bottoms 712 (see FIG. 1). In other words caps 710 without spouts 312 can be used as bottoms 712 for the closure of a container. Further, as described above, caps 710 and bottoms 712 can be positioned on the web 112 in any desired manner.

Figure 3:
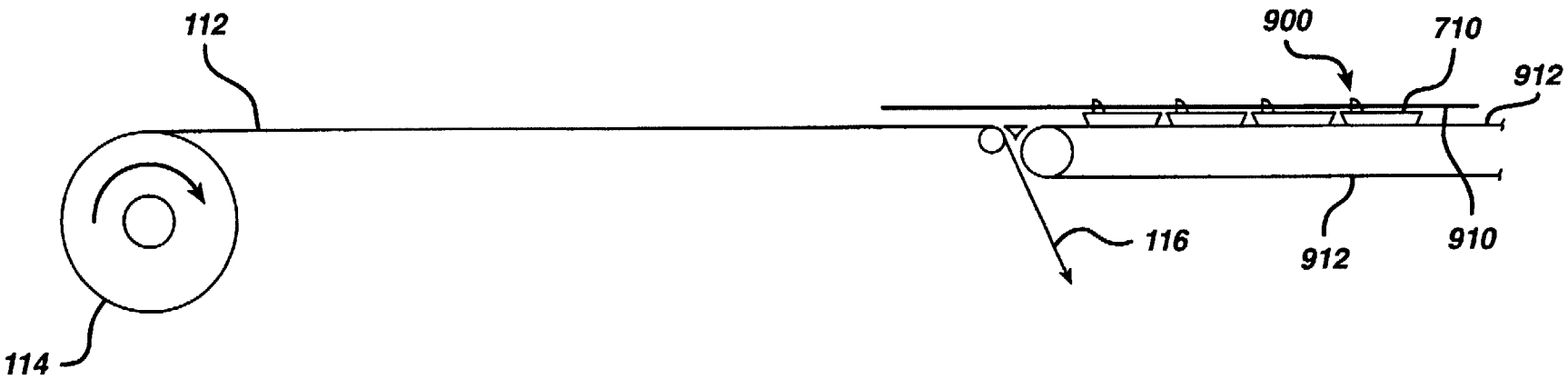
FIG. 3 is a side plan view of the process shown in FIG. 2.

As shown in FIG. 2, after the caps 710 are formed, arms 910 can be used to orient the position of the formed caps 710 so that they will be uniformly oriented for conveying by a conveyor 912 to the next location at which the caps 710 with spouts 312 will be affixed to the cylindrical portion of the container. As shown in FIG. 3, the salvage of the scrap 116 of the web 112 from which caps 710 have been made is then directed to either be wound on a take-up reel or fed to a chopper or other compactor for disposal (not shown).

Figure 5:
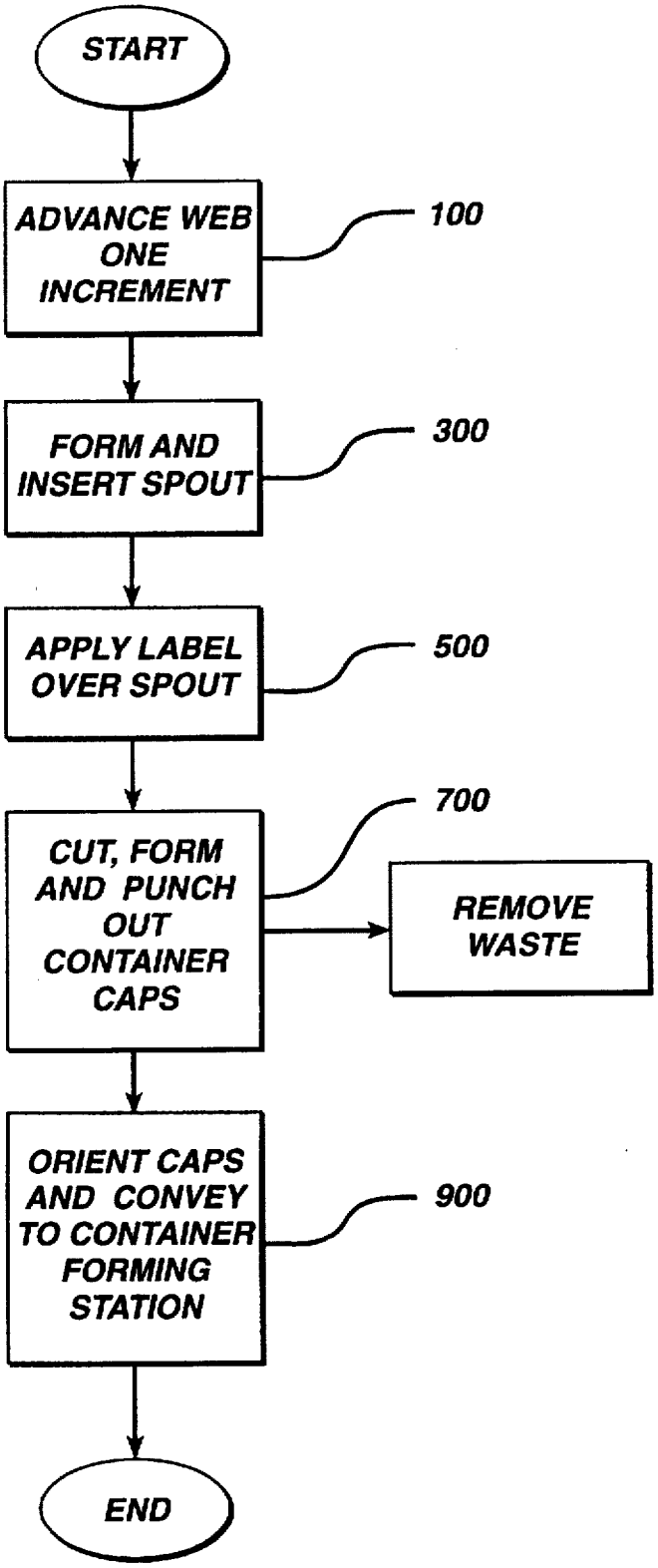
FIG. 5 is a flow chart of the process by which spouts are inserted and caps formed from a continuous web.
Figure 6:
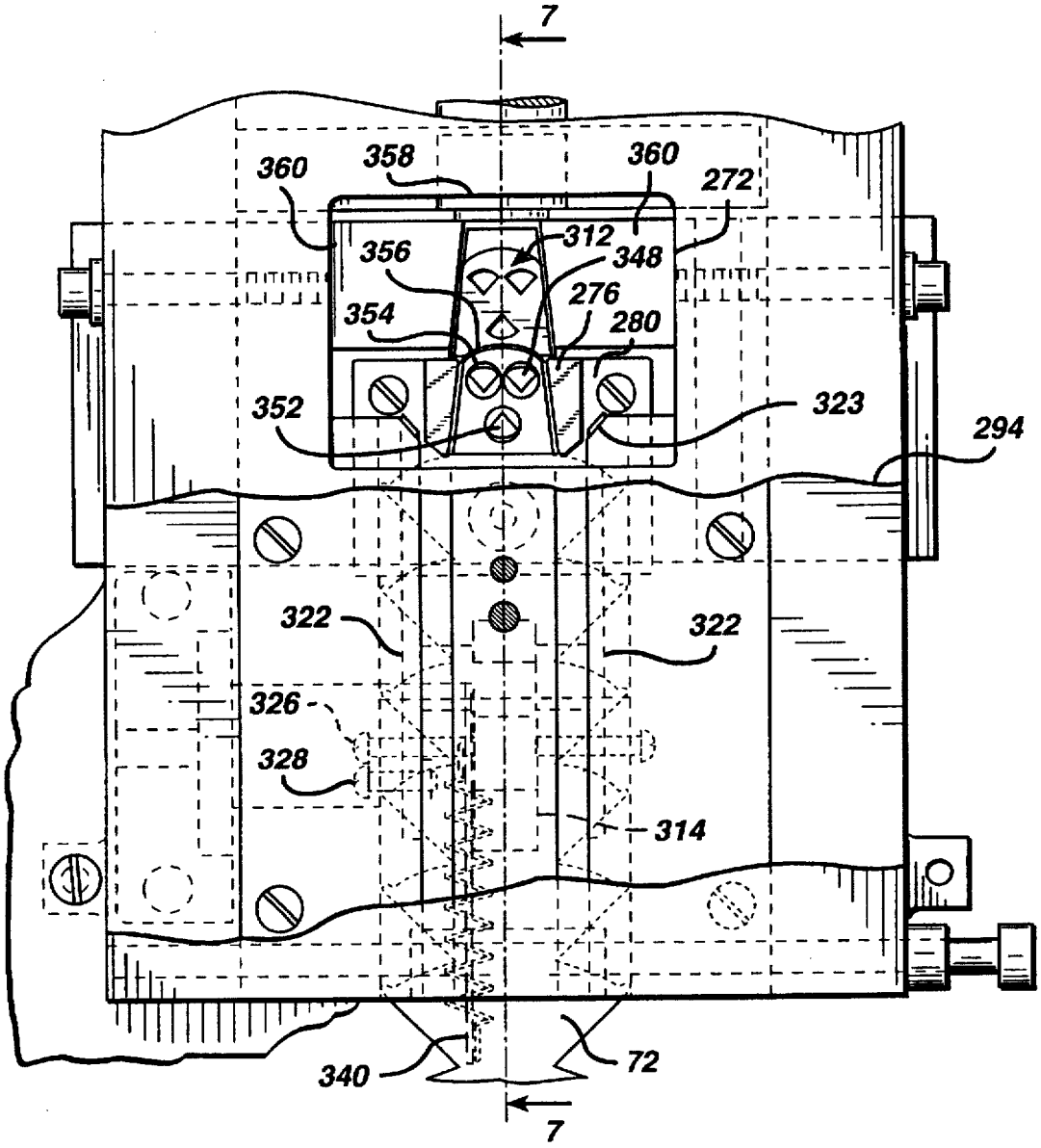
FIG. 6 is a side elevational view of a portion of the spout inserting mechanism, immediately before attachment of the spout to the web, and showing a portion of the side plate removed for clearness in illustration.
Figure 7:
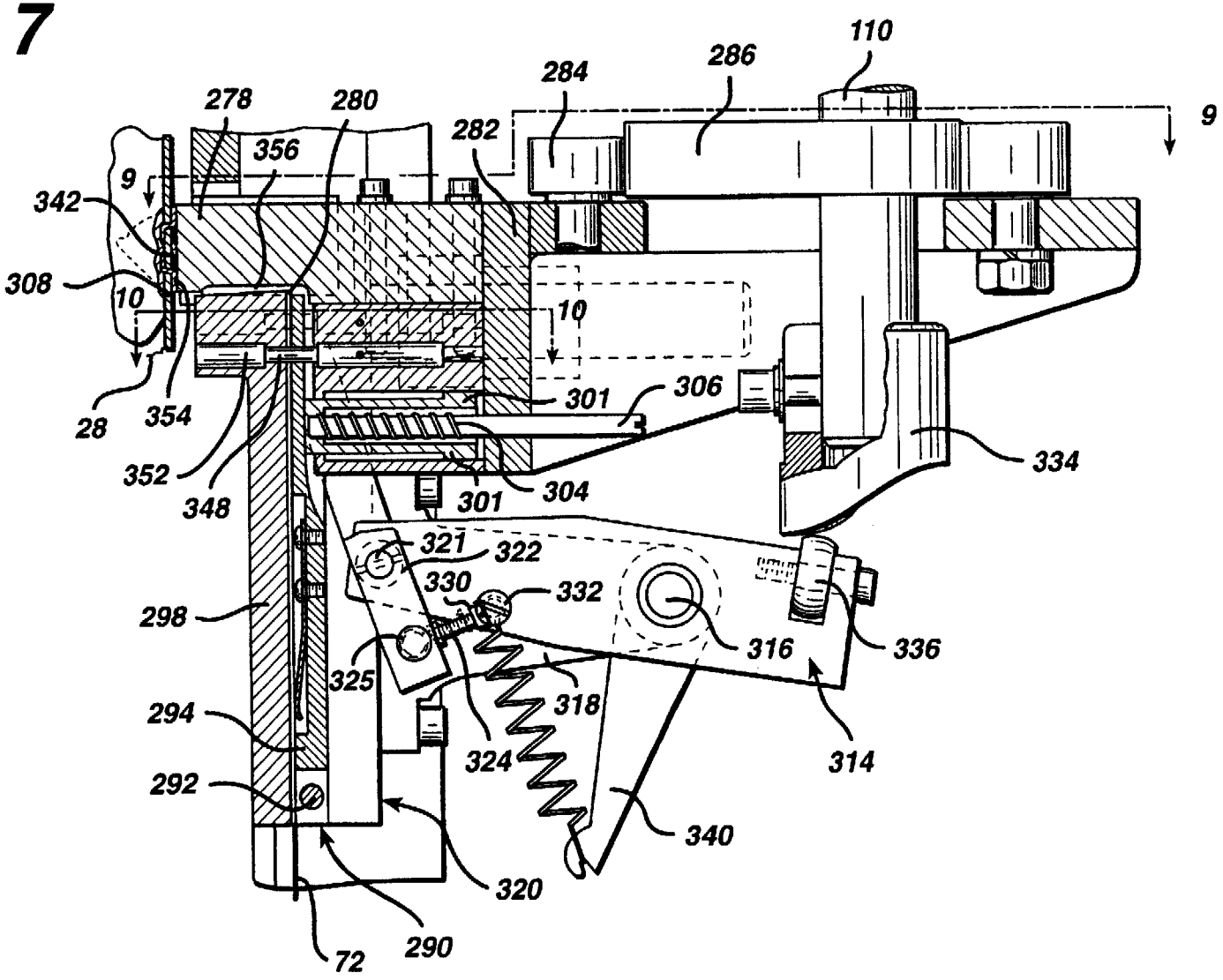
FIG. 7 is a fragmentary vertical sectional view of a spout-forming and spout-inserting mechanism taken along line 7—7 of FIG. 6 showing the dies and the ram and their respective spout-forming and spout-inserting position.

FIG. 5 shows schematically the process involved in forming caps 710 that has just been described. The first step comprises advancing the web one increment at station 100. The second step 300 involves forming and inserting a spout. Labels may be applied at the next station 500. The caps are cut, formed and punched out at the next step 700. Then the caps are oriented and conveyed to the container forming station at step 900. The scrap web material is removed by means not shown.

Referring now to FIGS. 6 through 11, which show a spout inserting apparatus, beneath and in alignment with the anvil is a rectangular opening 272 in a ram housing plate 274 and beneath the ram housing plate and in line with said opening is a fixed die 276 and a reciprocable ram 278 which, with the removable die 280 is connected to and moved by a support block 282 that is recipricable mounted and actuated by rollers 284 on the support block that follows a cam 286 mounted on a drive shaft 110 that is journaled in the upper plate 76.

As shown, preferably the fixed die 276 is formed at one end of a plate 288 that also serves as a part of the spout blank strip feed mechanism generally designated as 290. Pivoted at one end of the plate 288 opposite the fixed dye 276 on a pivot pin 292 is a stripper plate 294 that, with the plate 288, provides a guideway 296 for the spout blank strip 72 and is normally biased away from the plate 288 and carries a leaf spring 298 which serves to yieldingly press the blank strip 72 against the underside of the plate 288 and hold the strip 72 against movement. Adjacent the end of the stripper plate opposite its pivot pin 292 is a plunger 301 slidably mounted in a guide recess 302 in the movable die block and normally influenced against the stripper plate by a compression spring 304 that is held in position by a guide rod 306, one end of which is connected to the plunger 300 while the other end is slidably mounted in the support block 282.

During the operation of the machine, a spout blank strip 72 is fed step-by-step from a suitable supply such as a reel 70 journaled on the reel bracket frame to the dies and the ram. This strip of spout blanks is shown in including a plurality of spout blanks connected in end-to-end relation, each blank being shaped to provide the body portion 308 and side wings 310 of the finished spout 312.

The strip of blanks is fed by a mechanism comprising a lever 314 pivotally mounted intermediate its ends at 316 on a bracket arm 318 connected to a frame bar 320 secured to the housing plate. Pivotally connected to the end of the lever 314 on a common pivot pin 321 are a pair of feed dogs 322 the upper ends of which have inturned fingers 323 to engage behind the edges of the respective blanks of the blank strip. The feed dogs are normally influenced into feeding relation to the blank strip by a tension spring 324 one end of which is connected to a pin 326 on the feed dogs while the other end is connected to a screw 328 secured in the lever 314. Preferably an adjustable stop screw 330 is threaded into one of the dogs to abut another screw 332 coaxial with the screw 328 for limiting movement of the feed dogs in one direction under the influence of the spring 324.

The lever 314 is actuated by a feed cam 334 adjustable on the drive shaft 110 and followed by a follower roller 336 journaled on the lever 314. The roller 336 is normally held in contact with the cam by a spring 338 one end of which is connected to the screw 328 while its other end is connected to an arm 340 rigidly connected to the lever 314.

Figure 8:
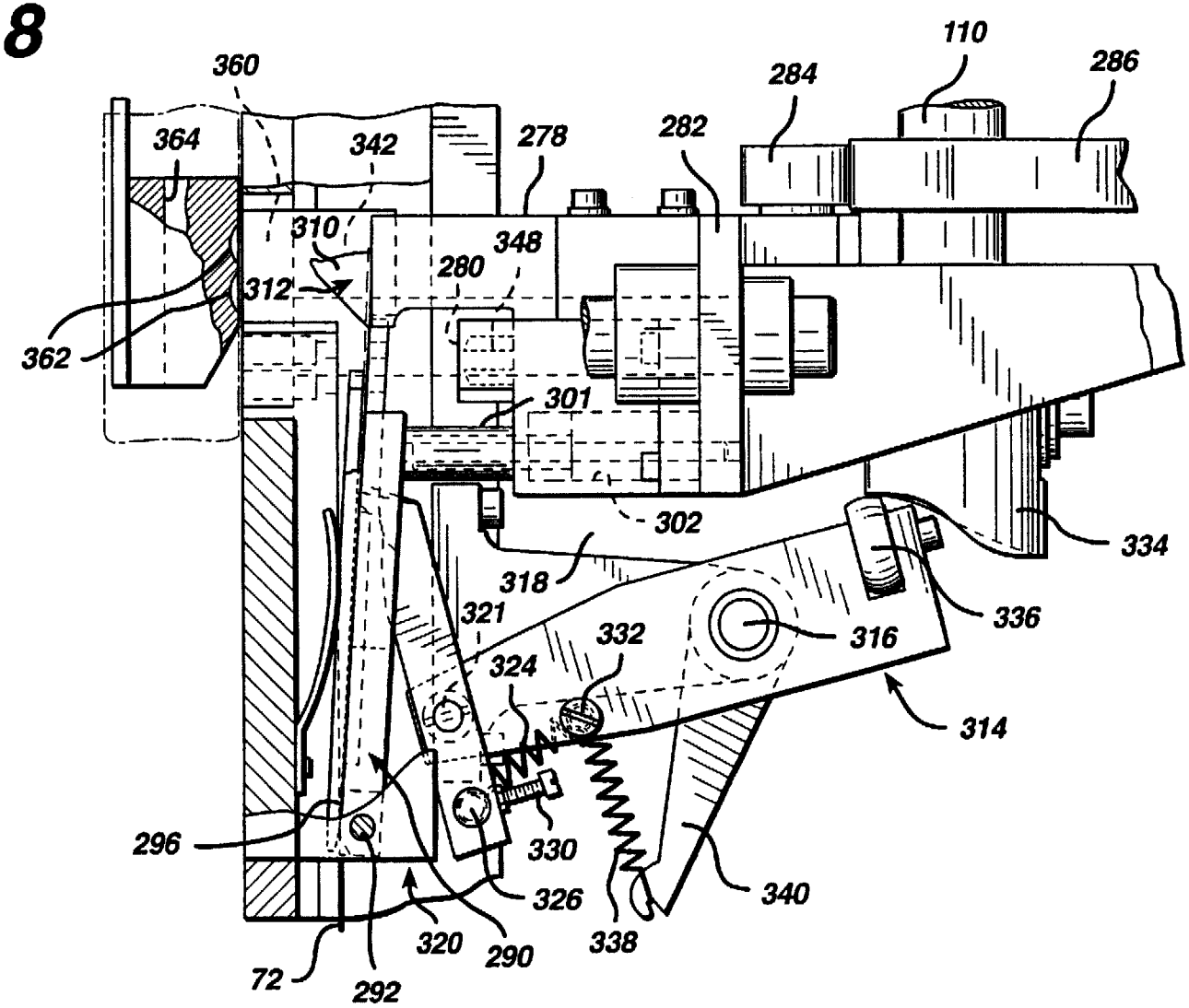
FIG. 8 is an enlarged fragmentary side elevation of the dies, the ram and the driving devices therefore, showing the movable dye and ram in retracted positions.
Figure 10:
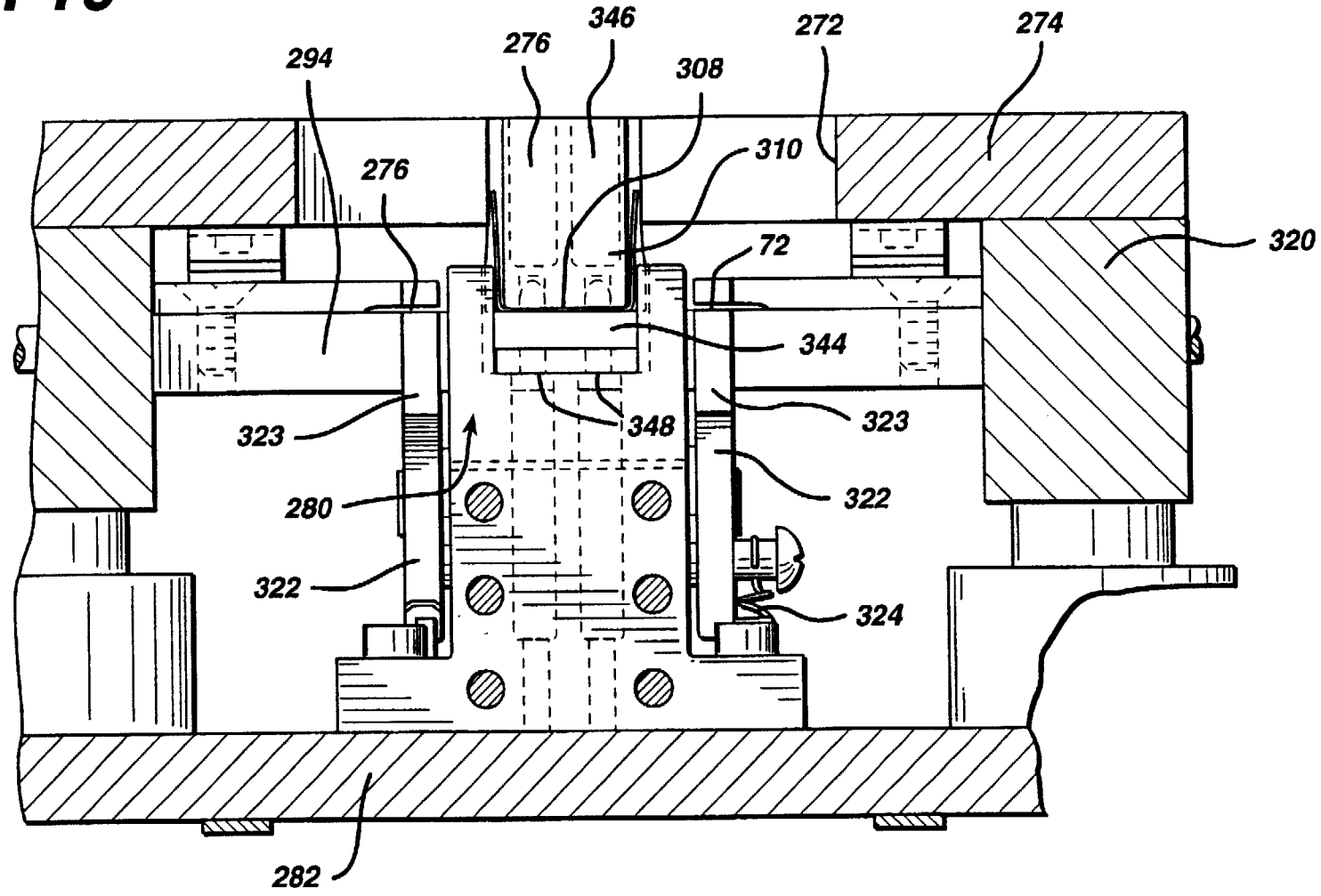
FIG. 10 is a fragmentary transverse vertical sectional view on the plane of 10—10 of FIG. 7.
Figure 13:
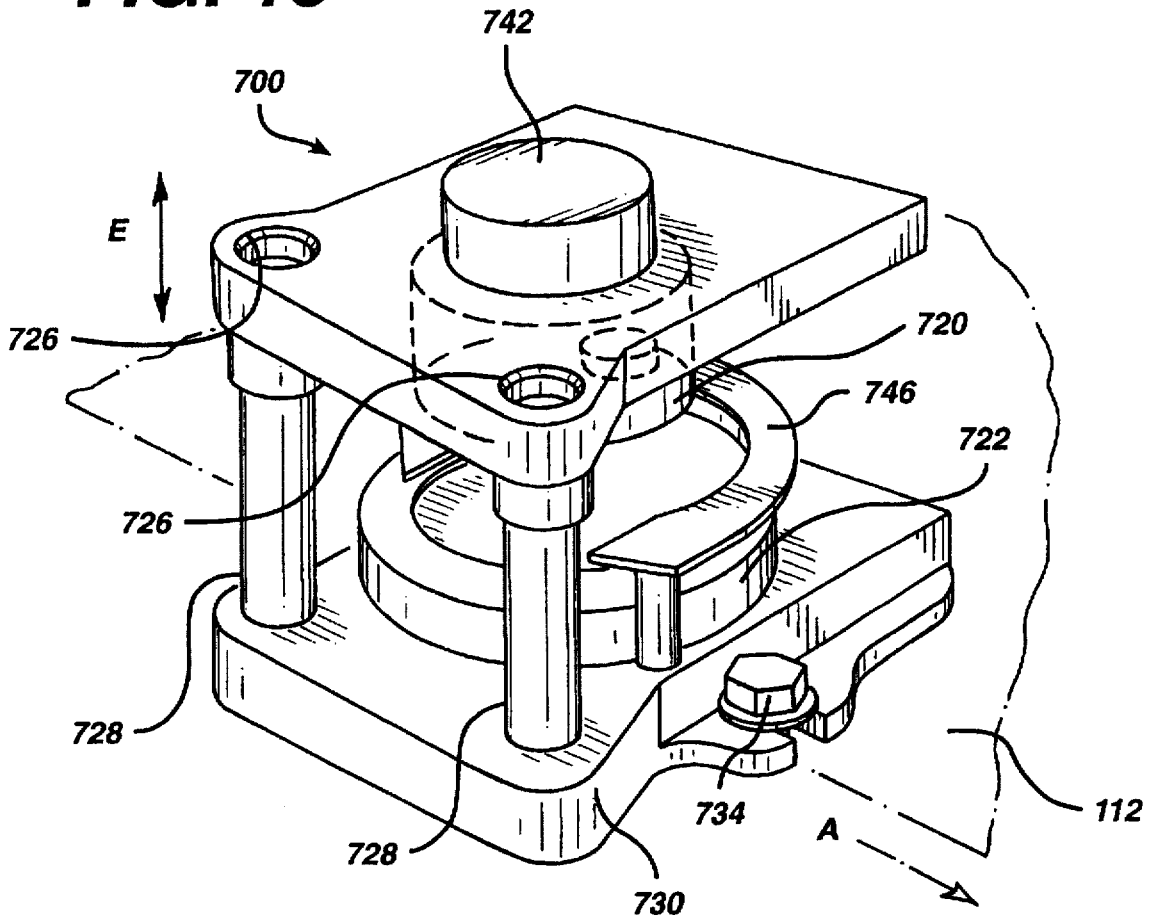
FIG. 13 is a perspective view of a cap dye and press for forming a cap from the web.
Figure 14:
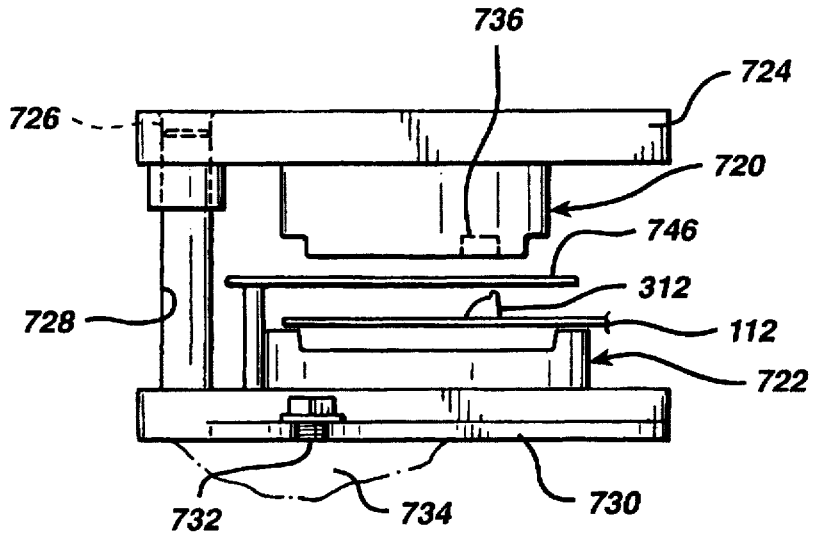
FIG. 14 is a side view of the cap dye and press shown in FIG. 13 in an open position with the web positioned therein.
Figure 16:
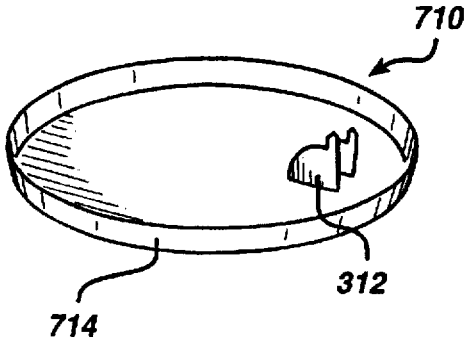
FIG. 16 is a perspective view of a formed cap.
Figure 15:
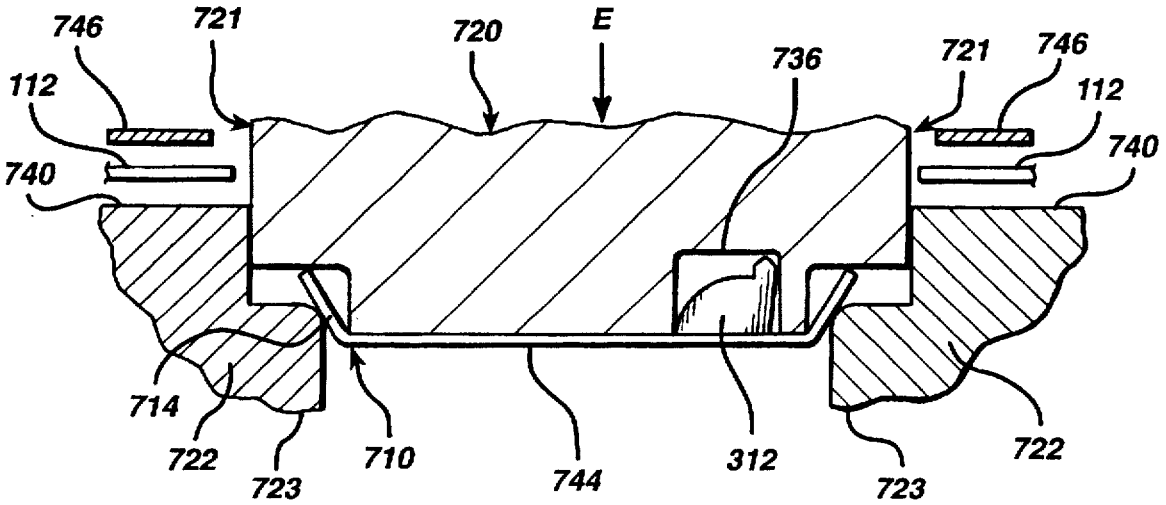
FIG. 15 is a cross-sectional view of the cap die and press shown in FIG. 13, in a closed position with the cap formed.

During operation of the machine, the web 112 is positioned in the arms of plate 134 and anvil block 27 is reciprocally brought downwards behind the web 112 by the action of barrel cam. The lever 314 is actuated by the cam 334 to reciprocate the feed dogs 322 and feed the blank strip 72 step-by-step so that at the end of each step a blank is brought onto position between the dies 276 and 278 for completing the formation of the spout 312, and a completed spout 312 is positioned with respect to the anvil. While the spout blank is at rest, the cam 286 moves the support block 282 to move the lower die 280 into coactive relation to the upper die 276 to complete the spout by bending the wings 310 upwardly from the body portion 308 and by forming prongs 342 for fastening the spout to the canister wall. The lowerside is formed with a channel 344 which coacts with a forming block 346 on the upper die for producing the wings, and the prongs 342 are formed by punches 348 secured in the lower die, which pass loosely through openings 350 in the stripper plate 294 and into the die holes 352. The support block 282 is then pushed by the cam 286 so that the punches 348 are withdrawn from the spout blank and the stripper plate which strips the spout from the punches, and the blank strips 72 are permitted to swing away from the upper dies as shown in FIG. 8.

Simultaneously with the formation of one spout, the ram 278 is moved, and the next preceding spout, that is, the spout at the leading end of the blank strip 72 is severed from the strip between blade edges 354 and 356 that are carried by the ram and the upper die, respectively. After severing the spout from the strip, the ram pushes the spout through a guide channel formed by the fixed die and the spaced apart end surfaces 358 of guide blocks 360. The ram forces the wings and prongs of the spout through the web 112 which is pressed against the anvil 270. The face of the anvil preferably has depressions 362 to deflect and cinch the prongs. The anvil, of course, has grooves 364 to provide a clearance for the flanges as the latter penetrate the wall of the web. After the spout has been inserted into and secured in the web, the anvil 270 is withdrawn from the web as described above.

Referring to FIG. 12A–D, a label applying mechanism is shown generally as 500 wherein fork 560 is attached to cylinder rod 592. Rod 592 is intermittently activated through pneumatic cylinder 594. Air is applied to cylinder 594 through hose 596. After the label 514 is deposited on the label support plate 546, rod 592 is pushed toward web 112 by pneumatic cylinder 594, pushing fork 560 and cam 554 toward web 112. Cylinder rod 592 extends toward web 112. Surface 598 on cam 554 rides on top of pin 580 until slot 578 engages and pivots about pin 580 causing the label support plate 550 to change its angle from a label receiving position, e.g. substantially horizontal, toward a label applying position, e.g. substantially vertical. Cylinder rod 592 extends toward 112, surface 599 on cam 554 rides on pin 580, until label 514 comes in contact with web 112 and adheres thereto. Upon retraction of cylinder rod 592 through the spring return of cylinder 594, surface 599 rides on pin 580 until slot 578 engages and pivots about pin 580 causing the label support plate 550 to pivot away from the label applying position, e.g. substantially vertical, toward the label receiving position, e.g. substantially horizontal. Another label is then applied to the label receiving station. It is unimportant for the purposes of the present invention whether the label is delivered to a vertical or horizontal surface. This label application is more fully described in U.S. Pat. No. 5,149,392, the entire disclosure of which is incorporated herein by reference. Any other label applying mechanism known in the art, such as a heat transfer mechanism, or a blow on label mechanism may be used in accordance with the teachings of this invention.

Referring now to FIGS. 13–16, the cap forming apparatus, generally indicated at 700, comprises essentially a male die 720 and a female die 722. The male die 720 is interconnected with a support surface 724 which includes apertures 726 sized to receive and ride on columns 728 which extend from base 730. This permits the male die 720 to be moved in the directions indicated by arrow E with respect to the female die 722. Base 730 may be attached by attachment means, for example screw 732 to a foundation 734.

In operation, web 112 is moved between male die 720 and female die 722 by means of a synchronization process. When the web is moved to a position wherein the spout 312 is in registration with recess 736 in the male die 720 the male die 720 is moved downward in the direction of arrow E with respect to female die 722. First, the cutting portion 720 of male die 720 contacts a cutting ring 740 to cut a round disk from the web 112. Thereafter, the male die 720 enters the female die 732 and pushes the round disk into the female die 722 to form the cap by bending the circumferential edge 714 of the cap to form a formed cap. The male die 720 continues to move through the female die 722 until the formed cap 710 is pushed through the female die 722. The lower edge 723 of the female die 722 acts as a stripper to remove the formed cap 710 from the male die 720 when the male die 720 is retracted from the female die 722.

A stripping ring 746 is mounted above the web 112 to prevent the scrap web from being pulled up when the male die 720 is retracted from the female die 722. The stripping ring 746 prevents the scrap web 122 from sticking to the cutting portion 711 of the male die 720.

After the formed cap 710 is pushed through the female die 722 it falls to a conveyor or other means so that it can be directed to the next stage for further processing in accordance with the teachings of this invention as previously discussed.

Other arrangement for punching caps from the web are considered to be within the scope of this invention.

Importantly, the die not only punches the cap out but forms the formed cap in a same process. Further, the die discussed herein is synchronized with the other processes of the present invention such that the inserted spouts are in registration with the recesses in the die so that the spouts are not affected during the operation.

Modifications of the foregoing may be made without departing from the spirit and scope of the invention. What is desired to be protected by Letters Patents is set forth in the appended claims.

What is claimed is:

1. An apparatus for forming caps for cylindrical containers, the caps including spouts, the apparatus comprising:

a supply roll of a web material;

advancing means for advancing the web along a predetermined path;

spout inserting means operatively disposed along the path of travel of the web to insert spouts into the web at pre-determined intervals;

label applying means operatively disposed along the path of travel of the web, further along the path of travel of the web from the spout inserting apparatus, for applying labels over spouts inserted into the web;

punch and die means operatively disposed along the path of travel of the web from the label applying apparatus, the punch and die means cutting circular disks from the web, the disks including spouts, the punch and die means having recesses for accommodating the spouts inserted into the web, the punch and die means thereafter forming caps from the circular disks by bending the outer circumference of the disks to form a cap that is attachable to a container;

stripping means on the punch and die means for stripping the scrap web from the punch and die means;

the formed caps pushed through the punch and die means, the formed caps falling to a conveyor means;

a waste disposal means for removing the scrap web;

conveyor means for conveying the formed caps to a cap attaching area;

guide means for guiding the formed caps along the conveyor;

orienting means for orienting the caps on the conveyor to facilitate attaching the caps to containers; and synchronizer means for synchronizing the advancing means with the spout inserting means and the label applying means and the punch and die means to position a spout inserted by the spout inserting means on the web at a designated location of the web to be disposed at a given position in caps formed by the punch and die means.

2. A method for forming caps for cylindrical containers, the caps including spouts, the method comprising:

supplying roll of a web material;

advancing the web along a pre-determined path;

inserting spouts into the web at predetermined intervals;

applying labels over spouts inserted into the web;

forming caps by punching circular disks from the web, the disks including spouts;

bending the outer circumference of the disks to form a cap that is attachable to a container;

stripping the scrap web from a punch and die means;

removing the scrap web;

conveying the formed caps to a cap attaching area;

guiding the formed caps along the conveyor and orienting the caps on the conveyor to facilitate attaching the caps to containers and;

synchronizing the steps of advancing the web, inserting the spout and applying the label and punching a cap from the web.

* * * * *